United States Patent [19]

Philips

[11] 4,406,422

[45] Sep. 27, 1983

[54] SPOOL ASSEMBLY

[75] Inventor: Michael R. Philips, Pomona, N.Y.

[73] Assignee: Jonathan Temple & Co., Inc., Hackensack, N.J.

[21] Appl. No.: 296,901

[22] Filed: Aug. 27, 1981

[51] Int. Cl.[3] ..... B65H 75/14

[52] U.S. Cl. ..... 242/118.4; 242/118.7

[58] Field of Search ..... 242/118, 118.4, 118.6, 242/118.61, 115, 116

[56] References Cited

U.S. PATENT DOCUMENTS

| | | | |
|---|---|---|---|
| 2,648,507 | 8/1953 | Kitzrow | 242/118.7 |
| 2,693,323 | 11/1954 | Jarmicki | 242/118.7 |
| 2,775,418 | 12/1956 | Cadman | 242/118.7 |
| 2,777,648 | 1/1957 | Wood | 242/118.7 |
| 2,858,999 | 11/1958 | Guenther, Jr. | 242/125.1 |
| 3,105,655 | 10/1963 | Park et al. | 242/118.7 |
| 3,270,980 | 9/1966 | Philips | 242/118.7 |
| 3,358,943 | 12/1967 | Pelson | 242/125.2 |
| 3,635,421 | 1/1972 | Boland et al. | 242/118.6 |
| 3,940,085 | 2/1976 | Campbell | 242/115 |
| 3,966,139 | 6/1976 | Terpak | 242/118.7 |
| 3,970,267 | 7/1976 | Sheetz | 242/115 |
| 4,068,808 | 1/1978 | King | 242/118.4 |

*Primary Examiner*—Leonard D. Christian

*Attorney, Agent, or Firm*—Weingram & Klauber

[57] ABSTRACT

An expendable spool for threads, yarns and the like, having a hub and flanges at both ends of the hub. The flanges are formed by two mirror symmetrical portions with each flange portion having a radial slot for receiving a projection of the other flange portion thereby forming interlockable but separable portions. The hub also comprises two mirror symmetrical portions, each of which is secured to a flange portion at each end so that the spool can be separated into mirror symmetrical halves. The flanges have central apertures and the hub has a central passage which is continuous between the flanges. The inner wall of the hub is provided with ribs having a triangular cross-section, the apices of which lie in a cylindrical surface for securing the hub to a spindle for rotation therewith.

13 Claims, 6 Drawing Figures

SPOOL ASSEMBLY

FIELD OF THE INVENTION

This invention relates to an improved spool for threads, yarns, and the like, and particularly to expendable spools for the wire serving industry.

BACKGROUND OF THE INVENTION

Wire serving is the process of wrapping a wire with an insulating material, e.g., fiberglass, to provide a continuous covering or coating for the wire.

In serving a thread or yarn on to a wire, usually the spool that carries the yarn is mounted on a hollow, rotating spindle through which the wire is drawn in the axial direction, the spindle and spool being rotated at a high speed while the wire passes axially through the spindle so that the yarn is drawn from the spool to be wrapped evenly onto the wire. When the yarn has been drawn completely from a spool, the empty spool is destroyed and is replaced by a new spool so that the winding may be continued without cutting the wire.

Often a wire serving process will have a ribbon composed of several threads dispensed from a single spool which is wrapped around a wire. When such thread ribbons are used, the function of the thread spool becomes more important in maintaining the consistency and operativeness of the thread ribbon. Any slackening of the various threads or even nonuniformity in the tension of the various threads will allow the ribbon to separate into individual strands and thereby cause gaps in the ribbon.

In order to make sure that the tension is maintained on all of the strands of the ribbon, the spool dispensing the thread ribbon must be accurately and fixedly positioned with relation to the wire. Further, the winding on the spools must be absolutely uniform.

If the axial or radial dimensions of the spools or the windings of thread on the spool varies, then the thread will be fed off the spool in different lengths as the spool revolves, causing unacceptable irregularities in the thread ribbon. Therefore, the dimensions of the spool and the dimensional stability of the spool and thread windings on the spool are of great importance to insure that the thread windings are equal and uniform. For example, if the flanges of the spool are not rigidly constructed the windings of thread can become uneven at the juncture of the hub section of the spool with the flange sections. This can result in a barrel-shaped thread winding on the hub of the spool with the radius of the thread winding being greater at the center than at the ends of the hub. The dimensional imprecision or instability of the flanges could also result in the thread windings on the hub being of uneven length between one layer of the winding and the next.

Another problem that exists with the presently available spools is when they become empty they must be broken to remove them from the spindle. Inevitably, the spools break up into pieces which may have jagged edges that can injure an operator. Additionally the action of breaking the spool results in pieces of the spool flying in the work area and causing a safety hazard.

Efforts have been made in the past to control the breakage of the spools by placing slots or grooves in the spool. However, while not solving the hazards of breakage, in addition, these slots and grooves can weaken the spool and make it prone to premature breakage.

Several spools have been designed to try and overcome these problems.

In U.S. Pat. No. 3,270,980 to Philips, a spool is described having a hub, adapted to fit on a spindle, and flanges at each end provided with grooves which facilitate fracturing and ready removal of the spool when empty.

Another such spool is described in U.S. Pat. No. 3,635,421, to Boland et al. This spool has two halves, each of which includes a flange and a hub half which has a semi-circular cross-section connected to and extending from the flange with complementary tongues and grooves formed along the longitudinal mating surfaces thereof. An inner face of each flange is provided with an arcuate recess for receiving a free end of the mating hub half.

The spool is assembled by aligning the mating tongues and grooves and then moving the halves slideably into engagement with each other to connect together the halves and then securing the halves together by inserting the free end of each hub half into the recess in the flange of the mating half. Disassembly follows the same procedure in reverse. The outer face of each flange is formed with inclined portions or surfaces, so that as the spool is rotated with the spindle, the flange is subjected to air pressures which maintain the spool on the spindle in a generally fixed position along the longitudinal axis of rotation.

A problem of the Boland spool is the lack of adaquate means to fix the dimensional stability of the distance between the flanges.

U.S. Pat. No. 3,105,655 to Park et al describes a solid spool having a slit in the core extending for the full length of the core and having end flanges which are frangible so that they may be readily broken to permit removal of the empty spool.

Other patents which deal with the spools that can be broken down but which do not meet the problems addressed by the present invention are U.S. Pat. No. 2,648,507 to Kitrow; U.S. Pat. No. 2,693,323 to Jarmicki; U.S. Pat. No. 2,777,648 to Wood; U.S. Pat. No. 2,858,999 to Guenther, Jr.; U.S. Pat. No. 3,105,655 to Park et al; U.S. Pat. No. 3,358,943 to Pelson; U.S. Pat. No. 3,635,421 to Boland et al; U.S. Pat No. 3,940,085 to Campbell; U.S. Pat. No. 3,966,139 to Terpak; U.S. Pat. No. 4,068,808 to King.

SUMMARY OF THE INVENTION

The present invention provides a spool formed from two identical halves which are assembled by sliding the halves together. Each half has a hub having flanges at each end which have radial slots for receiving complementary projecting portions which fit into the slots. The assembled spool has flanges formed by two mirror symmetrical portions which interlock but are separable along the radial slot. The hub also comprises two mirror symmetrical portions, each of which is secured to a flange portion at each end so that the spool can be separated into mirror symmetrical halves. Each of the flanges has a central aperture and the hub has a central passage which is continuous between the flanges. The inner surface of the hub is preferably provided with ribs for securing the hub to a spindle for rotation therewith. The ribs enable the firm mounting of the spool on the spindle, which may vary in dimension, without the necessity of either shimming or reaming to fit. The ribs can be of any operative (i.e. deformable) cross-sections such as triangular cross-section with the apices of the triangles lying in a cylindrical surface. The inner end surfaces of the ribs may be tapered to facilitate mounting the hub to a spindle.

When the spool is empty it is easily broken down or separated into separate portions and removed from the spindle simply by sliding the flange portions radially relative to each other, thereby removing the flange projections from the flange slots. There are no broken pieces with jagged edges which might harm an operator. In fact, other than for crushed hub ribs, the spool is unchanged and may be re-used, if desired, or thrown away.

Accordingly, an object of the invention is to provide a spool for serving thread, yarn and the like, which is easily broken down and removable from a spindle when empty.

A further object of the invention is to provide a spool for serving thread, yarn and the like which can be broken down clean leaving no jagged edges or pieces.

A still further object of the invention is to provide a spool for serving thread, yarn and the like which can be manufactured relatively inexpensively.

Yet another object of the present invention is to provide a spool for serving thread, yarn and the like which is not subject to premature breaking.

Still another object of the invention is to provide a spool for serving thread, yarn, and the like which can be easily broken down when empty and yet offers exceptional dimensional stability.

A further object of the present invention is to provide a spool for serving thread, yarn, and the like which encourages a uniform and dimensionally consistent wrapping of the thread on the spool.

Other objects and advantages will be apparent from the following description of the invention; and the novel features of the invention will be particularly pointed out hereinafter in the claims.

BRIEF DESCRIPTION OF THE DRAWINGS

The invention will be described with reference to the accompanying drawing in which.

DETAILED DESCRIPTION OF THE ILLUSTRATIVE EMBODIMENT OF THE INVENTION

Figure 1:
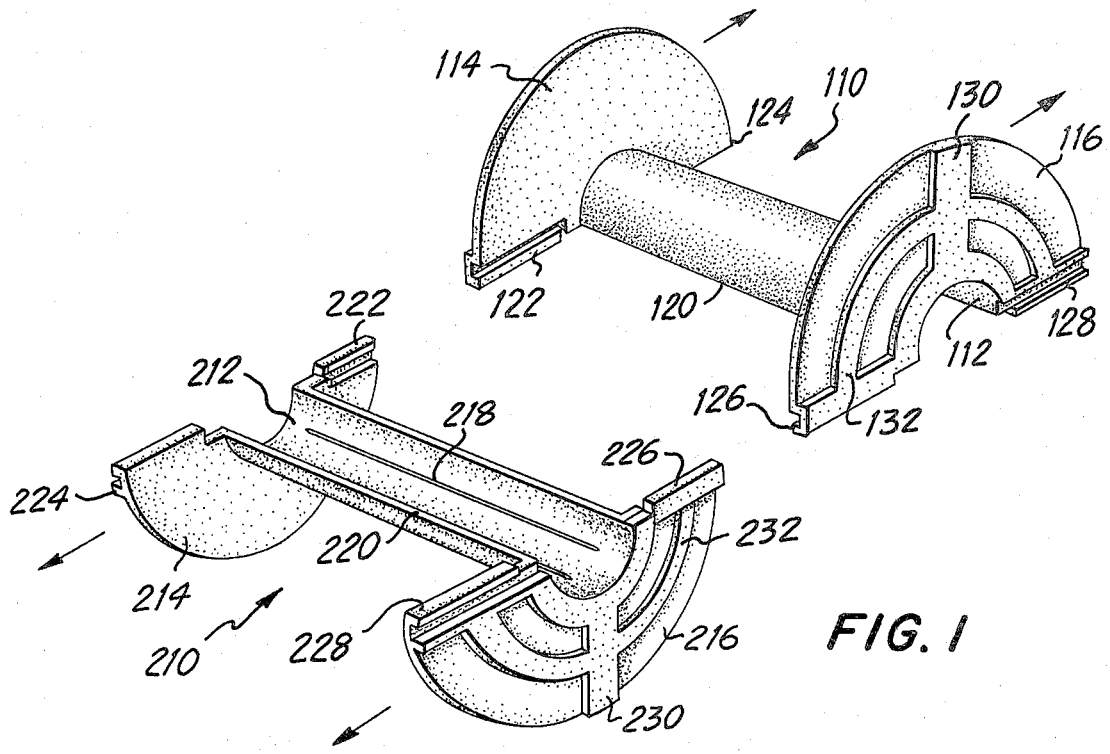
FIG. 1 is a view showing the two halves of the spool separated.
Figure 2:
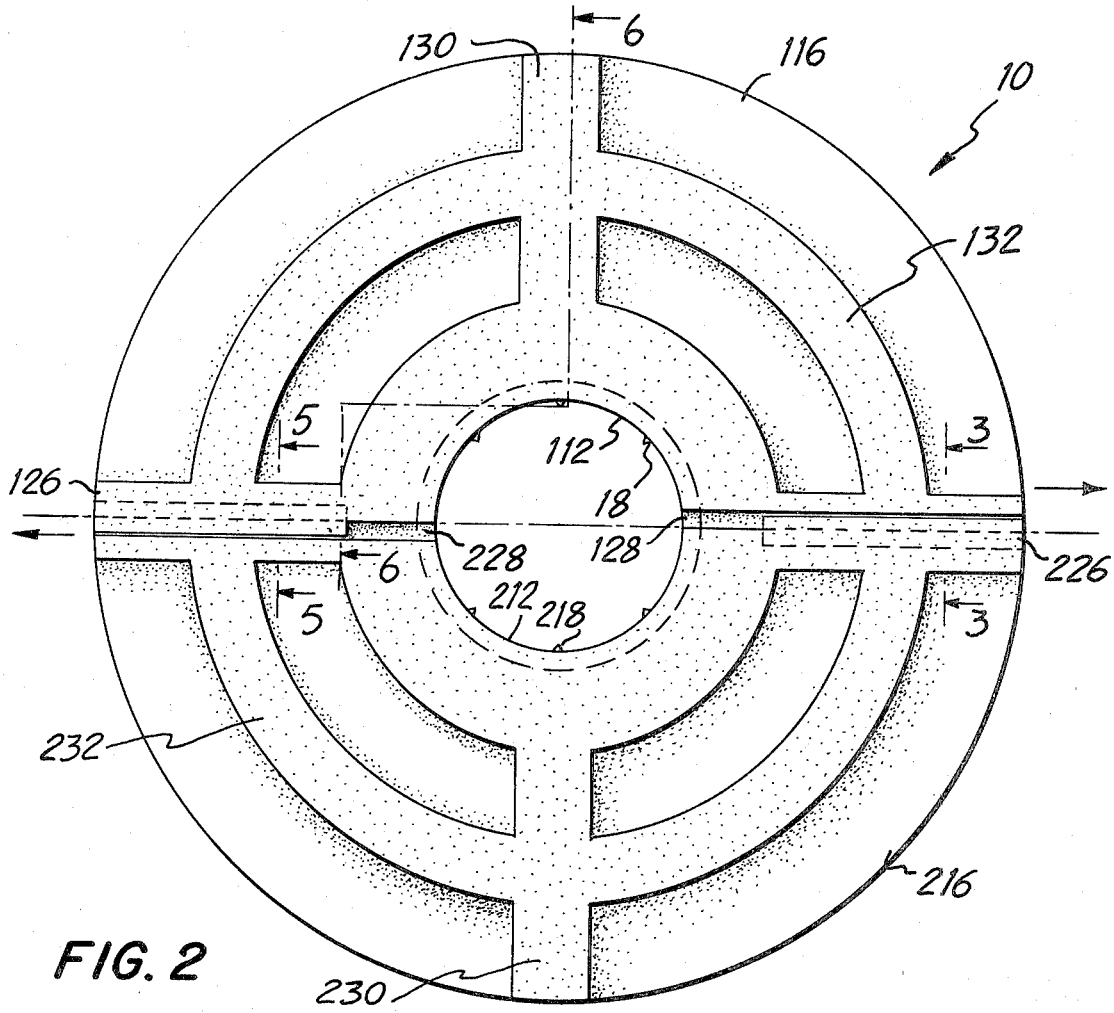
FIG. 2 is an end elevational view of the spool.
Figure 3:
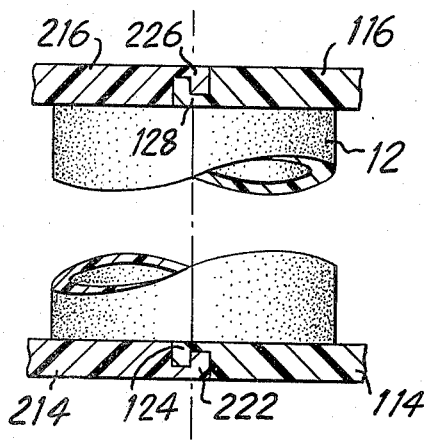
FIG. 3 is a sectional view along the lines 3—3 in FIG. 2.
Figure 5:
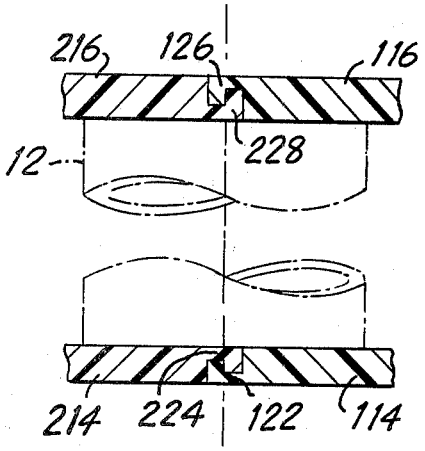
FIG. 5 is a sectional view of the spool along the lines 5—5 in FIG. 2.

The spool 10, preferably a plastic spool, comprises two identical halves 110 and 210 which are mirror symmetrical, i.e., complementary when joined together. The spool has a central hub 12 formed of upper and lower components 112 and 212 around which thread or yarn is wound and a flange 14, 16, respectively, at each end of the spool. Each flange 14, 15, 16 is formed of components 114 and 116 and lower components 214 and 216 respectively.

Each section of the hub 12 has ridges or ribs 18 on the inner surface thereof that are triangular in cross-section, the apices 20 of the triangles lying in a cylindrical surface. The ridges 18 are slightly deformed when the spool is placed on a spindle (not shown) to aid in securing the hub to the spindle.

Figure 4:
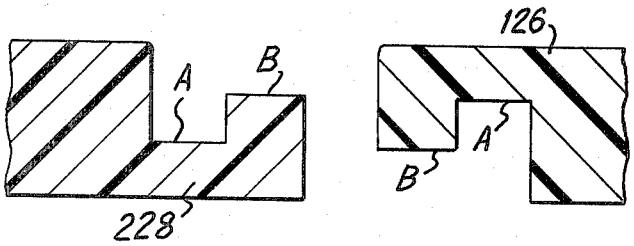
FIG. 4 is a sectional view of the flange portions of the spool separated.
Figure 6:
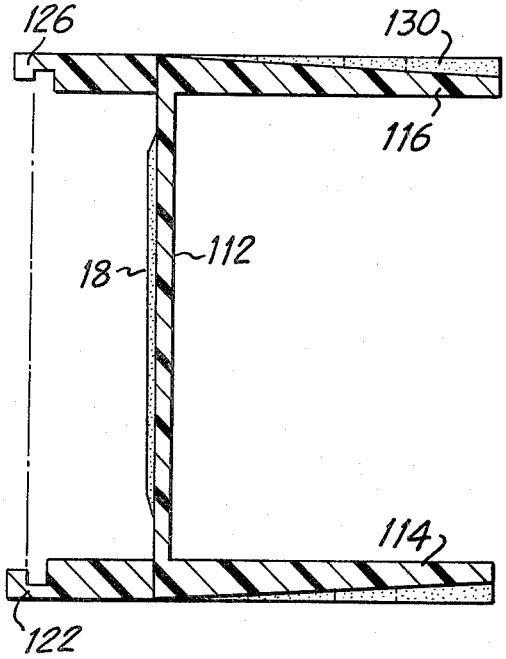
FIG. 6 is a sectional view of a portion of the spool.

Each hub section is joined at each end to a flange section. Therefore, upper hub section 112 would be joined to upper flange sections 114 and 116 respectively while lower hub section 212 would be joined to lower flange sections 214 and 216. The hub and flange sections have surfaces which mate and thereby form, when brought together, a unitary assembly. The upper and lower mating surfaces on the hub are 120 and 220 respectively, and run axially along the hub. The mating surfaces on the flange are tongue and groove or finger and slot assemblies. Two representative mating tongue and groove surfaces separated and enlarged are shown in FIG. 4 and identified in FIG. 4 as 122 and 228.

Each of the tongue and groove assemblies has a groove portion designated as (A) to which the tongue (B) of the opposing assembly is adapted to fit thereby allowing a sliding engagement between the sections of the flanges which produces great rigidity in the axial dimension of the spool and also with respect to resistance to torque by the flanges. The corresponding tongues and grooves, 126 and 228, 128 and 226, on flange 116 and 216, and 124, and 222; and 122, 224 on flanges 114 and 214. Connect the upper and lower halves of the spool, 120 and 220.

The upper and lower halves of the spools are aligned by means of the ends of the inwardly facing grooved portions 122 and 126 of the upper half 110 and 222 and 226 in the lower halves 210. When the outwardly facing grooves slide to the end of the inwardly facing grooves they stop at the end of the internal groove portion and that point is accurately positioned so that the hub mating sections, 120, 220 will exactly coincide. Once the upper and lower portions are assembled, the thread is wound around the hubs and therefore holds the hub assemblies firmly in place.

Rigidity and strength is provided for the flanges of the assembled spool by the interlocking tongue and groove surfaces of the flanges just discussed and by a series of stiffening ribs. The stiffening ribs are used to conserve material used to form the flanges and, therefore, produce a more economical product.

As shown in the drawings, the flanges have a series of radial stiffening arms 130 and 230 on the upper and lower flanges respectively and a circumferential thickened ring 132 and 232 on the upper and lower flanges respectively. Similarily, the hub section on the flanges is also appropriately thickened.

OPERATION

To assemble the spool, the two halves are brought together and the projecting portions of each flange portion slide into the corresponding radial slots of the other flange portion. The spool is now ready to receive yarn or thread.

After the spool has been wound it can be placed on a mandrel to dispense its contents.

When the thread is dispensed from the hub of the spool and the spool is empty, the spool need not be shattered or otherwise damaged to be removed from the mandrel. All that is necessary is that the upper and lower halves of the spool be slid out of mating contact and simply removed from the mandrel. This provides an effective method of removing the hubs without having to worry about breaking something which is always an uncontrolled action and always subject to hazards and other uncertainties.

It will be understood that various changes in the details, materials, and arrangements of parts which have been described and illustrated in order to explain the nature of the invention may be made by those skilled in the art within the principle and scope of the invention as expressed in the appended claims.

What is claimed is:

1. A spool comprising:
a first flange having a central aperture therein;
a second flange having a central aperture therein;
a segmented hub rigidly secured to said first and second flange;
said hub having an internal passage which is continuous from said first to said second flanges and is aligned with the apertures in said flanges;
each of said flanges comprising two separate inter-fitting portions; and
said hub having a segment connected to an inter-fitting portion of each flange;
each portion of said flange having a radial slot adapted to receive a radial projection from the other portion of the flange whereby said flange portions are interlockable but separable.

2. A spool as claimed in claim 1 in which said hub comprises two segments separable from one another.

3. A spool as claimed in claim 1 further comprising a plurality of ribs extending the length of said internal passage on the inner wall of said hub.

4. A spool as claimed in claim 3 in which the ribs have apices lying in a cylindrical surface.

5. A spool as claimed in claim 2 in which each hub segment is secured to one portion of each flange.

6. A spool as claimed in claim 2 further comprising means to align the segments said alligning means comprising stop means disposed in the radial slot, said stop means adapted to coact with the radial projection to radially position the interlocking flange portions.

7. A separable spool for dispensing thread and yarns and the like comprising:
a pair of mating spool portions
each spool potion comprising:
a hub portion;
a flange portion fixed at each end of said hub portion;
each of said flange portions having a radial edge; a cylindrical passage of less than circular cross section extending through the hub portion and both flange portions;
radially slidable interlocking means on the radial edge of each flange portion adapted to coact with the interlocking means on the mating flange portion radial edge.

8. A separable spool as claimed in claim 7 wherein each of said pair of mating spool portions are identical the one with the other.

9. A separable spool as claimed in claim 7 wherein said flange portions are semi circular.

10. A separable spool as claimed in claim 7 further comprising:
a plurality of ribs extending the length of said internal passage on the inner wall of said hub, and
said ribs have apices lying in a cylindrical surface.

11. A separable spool claimed in claim 7 wherein said radially slidable interlocking means comprise coacting tongue and groove assemblies on adjacent mating surfaces.

12. A separable spool as claimed in claim 11 wherein said tongue and groove assemblies are disposed on each of the two radial edges of said flange portion; and
said tongue and groove portions on each flange portion facing in opposite directions.

13. A separable spool as claimed in claim 11 further comprising alignment means disposed in said grooves to position adjacent edges of said flange portions relative each other.

* * * * *